US009934953B1

(12) United States Patent
Saetveit et al.

(10) Patent No.: US 9,934,953 B1
(45) **Date of Patent: *Apr. 3, 2018**

(54) DETERMINATION OF METAL AND METALLOID CONCENTRATIONS USING ICPMS

(71) Applicant: Elemental Scientific, Inc., Omaha, NE (US)

(72) Inventors: Nathan Saetveit, Omaha, NE (US); Daniel R. Wiederin, Omaha, NE (US)

(73) Assignee: Elemental Scientific, Inc., Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/194,917

(22) Filed: Jun. 28, 2016

Related U.S. Application Data

(63) Continuation of application No. 14/703,828, filed on May 4, 2015, now Pat. No. 9,406,490.

(60) Provisional application No. 61/987,886, filed on May 2, 2014.

(51) Int. Cl.

| | |
|---|---|
| ***H01J 49/00*** | (2006.01) |
| ***H01J 49/10*** | (2006.01) |
| ***H01J 49/14*** | (2006.01) |

(52) U.S. Cl.
CPC ..... *H01J 49/105* (2013.01); *H01J 49/0031* (2013.01); *H01J 49/145* (2013.01)

(58) Field of Classification Search
CPC ..... H01J 49/105; H01J 49/0031; H01J 49/145
USPC ..... 250/281, 282, 288
See application file for complete search history.

(56) References Cited

U.S. PATENT DOCUMENTS

| | | | | |
|---|---|---|---|---|
| 5,767,512 | A | 6/1998 | Eiden et al. | |
| 9,406,490 | B1 * | 8/2016 | Saetveit | H01J 49/105 |
| 2008/0261321 | A1 | 10/2008 | Patton et al. | |
| 2011/0052447 | A1 | 3/2011 | Roy et al. | |
| 2013/0119271 | A1 | 5/2013 | Liu et al. | |

* cited by examiner

*Primary Examiner* — Nicole Ippolito
(74) *Attorney, Agent, or Firm* — Advent, LLP

(57) ABSTRACT

A system for determining an analyte by inductively coupled plasma mass spectrometry (ICPMS) includes a sample introduction device having a heated cyclonic spray chamber. The system is configured to introduce sample that includes a metal and/or a metalloid having an organic interferent. The system also includes an inductively coupled plasma mass spectrometry device with a collision/reaction cell configured to receive a mixture of gases including both ammonia and hydrogen. A method includes introducing a sample to plasma to produce a characteristic spectrum associated with an elemental composition of the sample. The method also includes introducing both ammonia and hydrogen to a collision/reaction cell to remove carbon-based interferences to detection of the sample prior to determining the elemental composition of the sample.

18 Claims, 5 Drawing Sheets

DETERMINATION OF METAL AND METALLOID CONCENTRATIONS USING ICPMS

CROSS-REFERENCE TO RELATED APPLICATIONS

Figure 1:
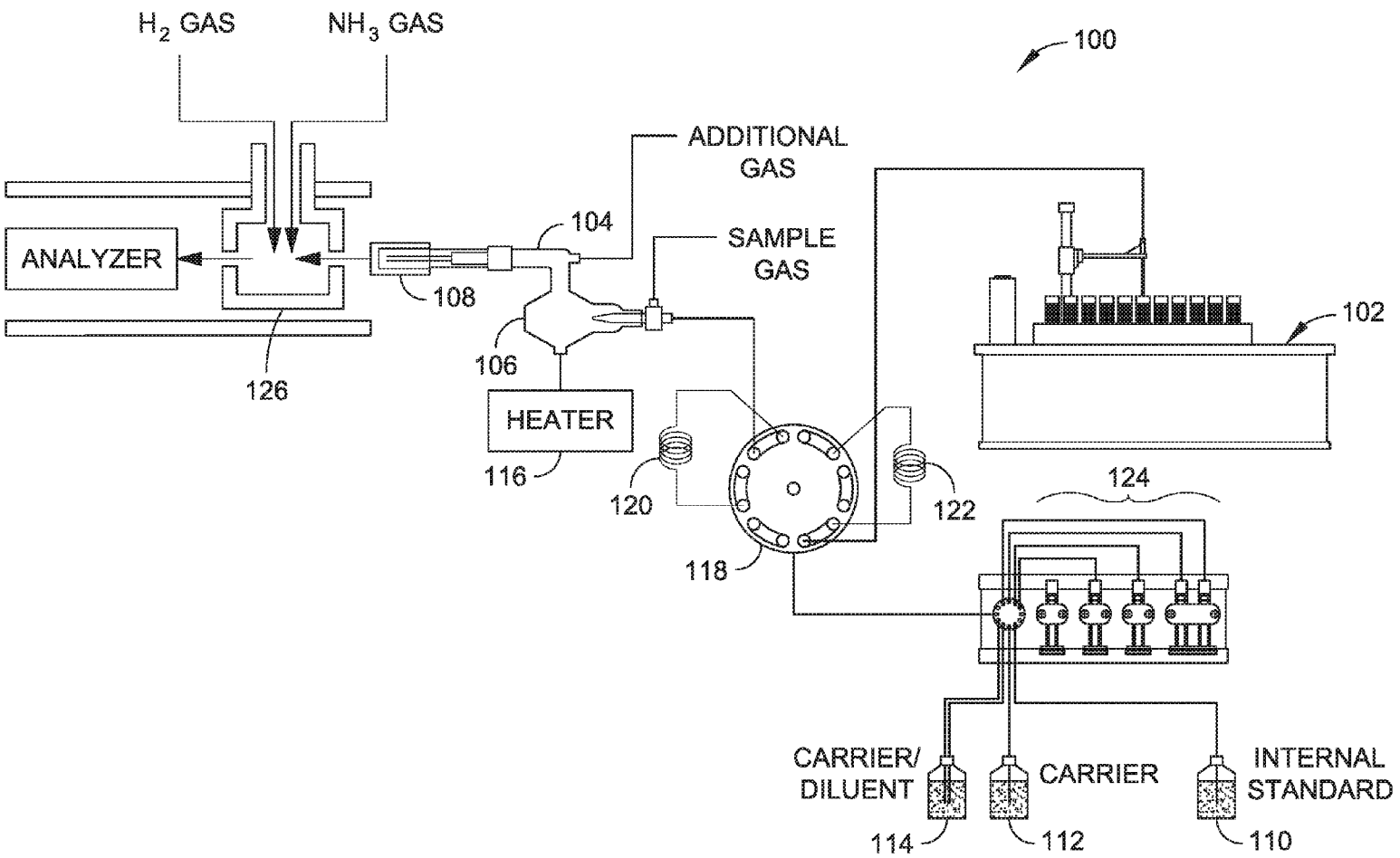

The present application is a continuation under 35 U.S.C. § 120 of U.S. patent application Ser. No. 14/703,828, filed May 4, 2015, and titled "DETERMINATION OF METAL AND METALLOID CONCENTRATIONS USING ICPMS," which itself claims the benefit under 35 U.S.C. § 119(e) of U.S. Provisional Application Ser. No. 61/987,886, filed May 2, 2014, and titled "DETERMINATION OF METAL CONCENTRATIONS USING ICPMS." U.S. patent application Ser. No. 14/703,828 and U.S. Provisional Application Ser. No. 61/987,886 are herein incorporated by reference in their entireties.

BACKGROUND

Inductively Coupled Plasma (ICP) spectrometry is an analysis technique commonly used for the determination of trace element concentrations and isotope ratios in liquid samples. ICP spectrometry employs electromagnetically generated partially ionized argon plasma which reaches a temperature of approximately 7,000K. When a sample is introduced to the plasma, the high temperature causes sample atoms to become ionized or emit light. Since each chemical element produces a characteristic mass or emission spectrum, measuring the spectra of the emitted mass or light allows the determination of the elemental composition of the original sample.

Sample introduction systems may be employed to introduce the liquid samples into the ICP spectrometry instrumentation (e.g., an Inductively Coupled Plasma Mass Spectrometer (ICP/ICPMS), an Inductively Coupled Plasma Atomic Emission Spectrometer (ICPAES), or the like) for analysis. For example, a sample introduction system may withdraw an aliquot of a liquid sample from a container and thereafter transport the aliquot to a nebulizer that converts the aliquot into a polydisperse aerosol suitable for ionization in plasma by the ICP spectrometry instrumentation. The aerosol is then sorted in a spray chamber to remove the larger aerosol particles. Upon leaving the spray chamber, the aerosol is introduced into the plasma by a plasma torch assembly of the ICPMS or ICPAES instruments for analysis.

SUMMARY

A system for determining an analyte by inductively coupled plasma mass spectrometry (ICPMS) includes a sample introduction device having a heated cyclonic spray chamber. The system is configured to introduce sample that includes a metal and/or a metalloid having an organic interferent. An organic interferent can be from the presence of organic matter in the sample (e.g., the presence of an organic solvent, such as xylene, kerosene, hexane, etc.). The system also includes an inductively coupled plasma mass spectrometry device with a collision/reaction cell configured to receive a mixture of gases including both ammonia and hydrogen. A method includes introducing a sample to plasma to produce a characteristic spectrum associated with an elemental composition of the sample. The method also includes introducing both ammonia and hydrogen to a collision/reaction cell to remove carbon-based interferences to detection of the sample prior to determining the elemental composition of the sample.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

FIG. 1 is a diagrammatic illustration of a system configured to introduce a sample to a plasma to produce a characteristic spectrum associated with an elemental composition of the sample, where the sample can include silicon having an organic interferent, and where, prior to determining the elemental composition of the sample, both ammonia and hydrogen can be introduced to a collision/reaction cell to remove at least one carbon-based interference in accordance with example embodiments of the present disclosure.

Figure 2:
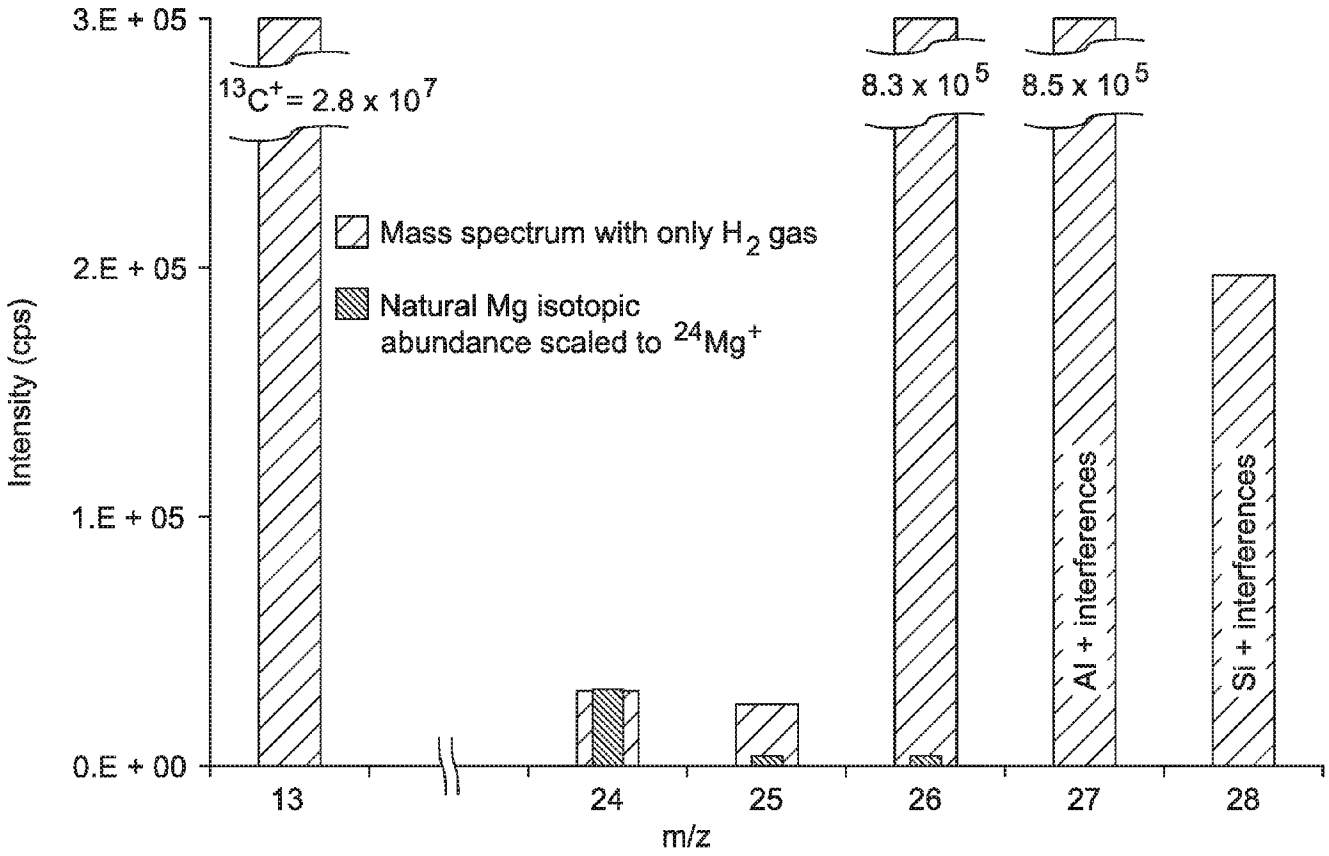

FIG. 2 is a graph illustrating isotopic abundances, where signal intensity in counts per second versus atomic mass number to ion charge number ratio is shown for ICPMS analysis of a sample including silicon having an organic solvent, and where, prior to determining the elemental composition of the sample, hydrogen is introduced to a collision/reaction cell.

Figure 3:
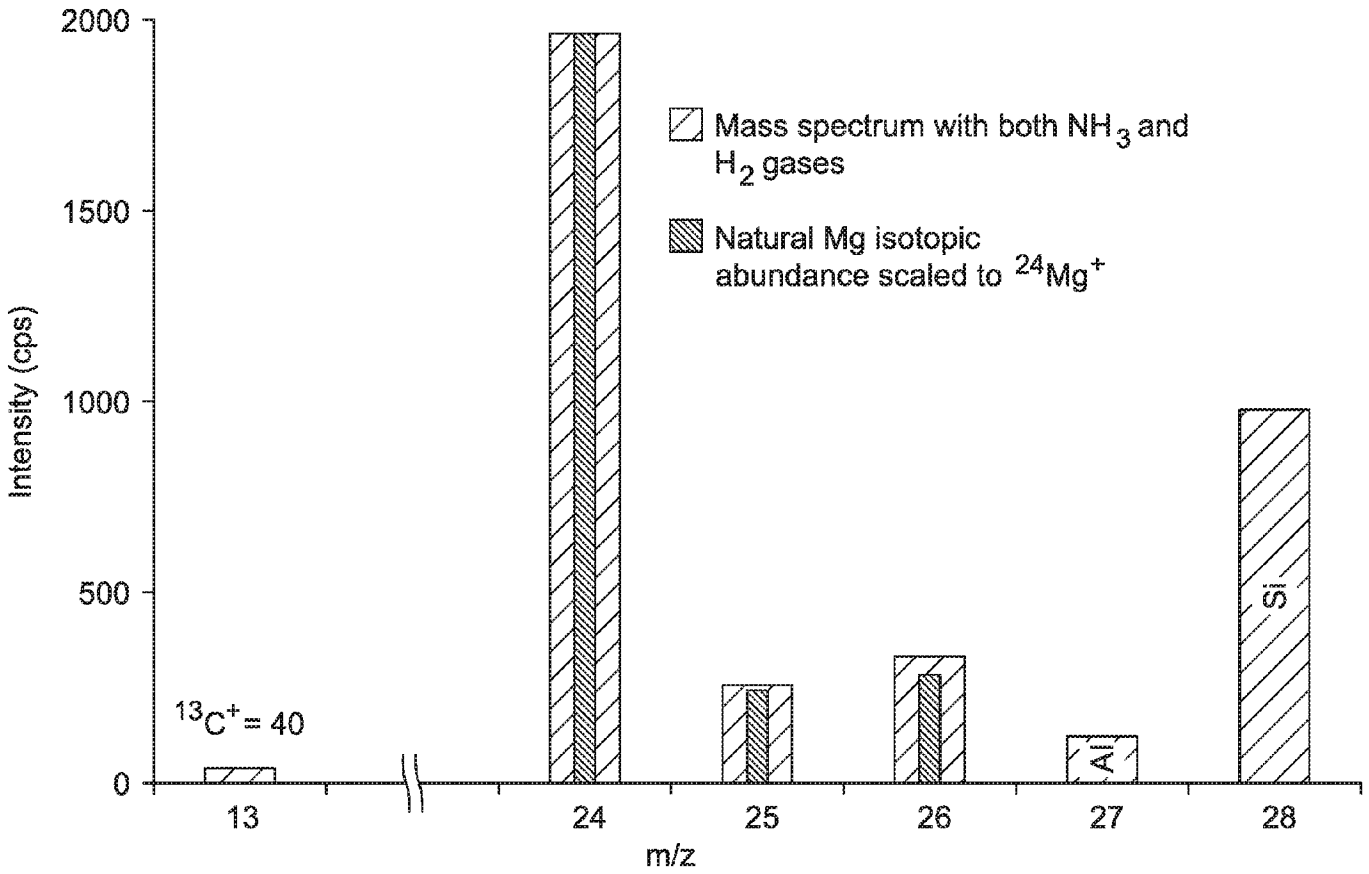

FIG. 3 is a graph illustrating isotopic abundances, where signal intensity in counts per second versus atomic mass number to ion charge number ratio is shown for ICPMS analysis of a sample including silicon having an organic solvent, and where, prior to determining the elemental composition of the sample, both ammonia and hydrogen are introduced to a collision/reaction cell in accordance with an example embodiment of the present disclosure.

Figure 4:
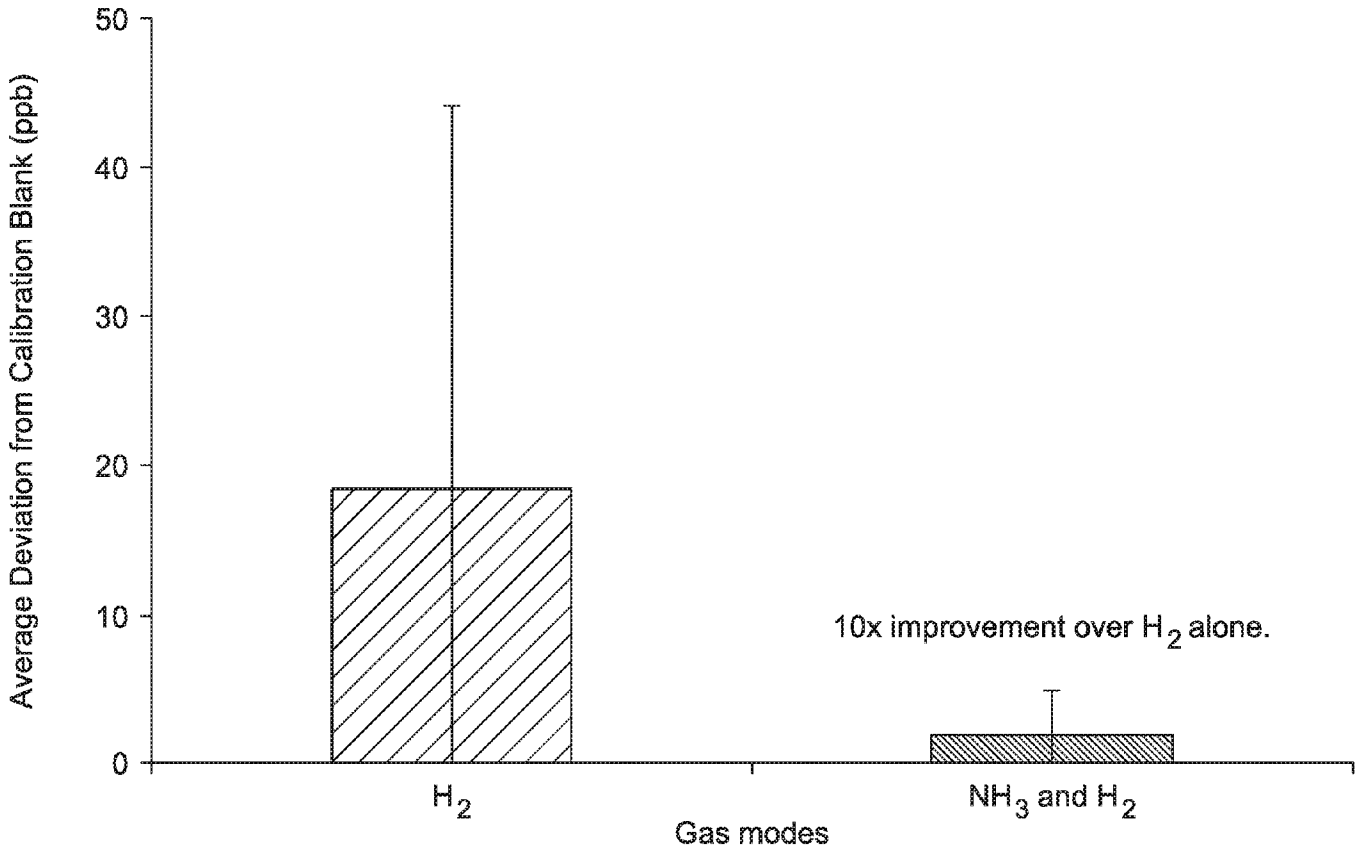

FIG. 4 is a graph illustrating blank reproducibility in different solvents, where average deviations from a xylene blank in parts per billion for ICPMS analysis of samples including silicon with three different solvents (xylene, kerosene, and hexane) is shown for a first mode, where, prior to determining the elemental composition of the sample, hydrogen is introduced to a collision/reaction cell, and for a second mode, where, prior to determining the elemental composition of the sample, both ammonia and hydrogen are introduced to the collision/reaction cell in accordance with example embodiments of the present disclosure.

Figure 5:
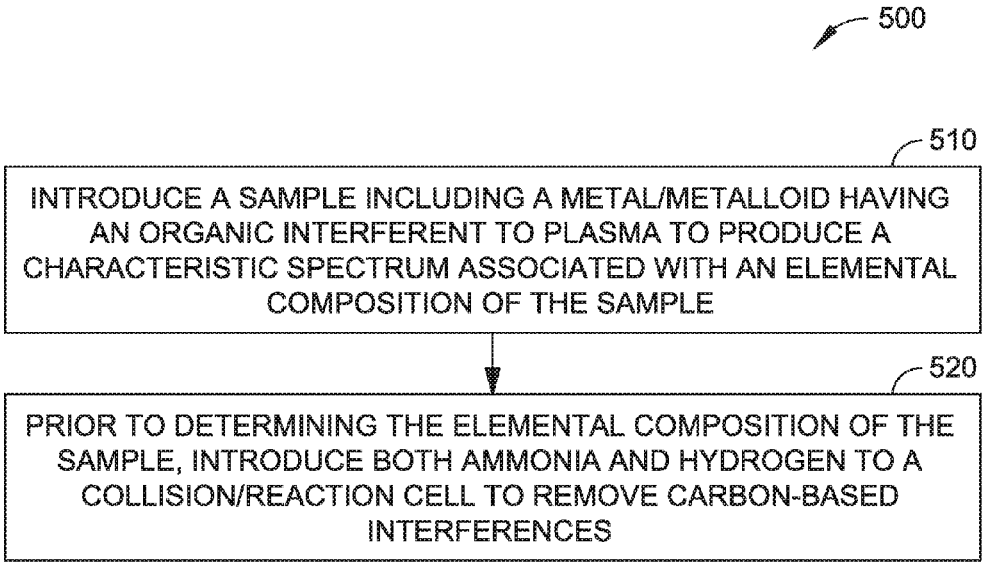

FIG. 5 is a flow diagram illustrating a method for determining the elemental composition of a sample including a metal and/or a metalloid having an organic interferent, where both ammonia and hydrogen are introduced to a collision/reaction cell to remove carbon-based interferences to detection of the sample in accordance with example embodiments of the present disclosure.

DETAILED DESCRIPTION

Referring generally to FIGS. 1 through 5, systems 100 and techniques 500 are described that can determine metal and/or metalloid concentrations using ICPMS. For example, accurate determination of silicon (Si) in undiluted organic solvents is performed by ICPMS analysis. Systems and techniques in accordance with the present disclosure can provide fully automated, syringe-based sample introduction, autocalibration and autodilution, analysis of undiluted organic solvents, automatic addition of internal standard, accurate metal/metalloid results (e.g., regardless of species), syringe and/or vacuum loading of samples, and so forth. In some embodiments, metals and/or metalloids can include silicon, magnesium, aluminum, and so forth. However, in other embodiments, organic interferences to different materials can also be reduced and/or removed, such as organic interferences during analysis of samples including phosphorus.

Rapid multi-element capabilities and superb detection limits often make ICPMS the technique of choice for trace elemental determination. However, determination of silicon by ICPMS can be hindered by very high background, mostly from the presence of polyatomic interferences, such as carbon monoxide (CO) and nitrogen ($N_2$). In organic solvents, silicon determination can be further complicated by the increased abundance of carbon-based interferences from the solvent.

Analysis of organic solvents by ICPMS can be performed by diluting samples in a xylene solvent and introducing a sample into a chilled spray chamber at a flow rate between about one hundred microliters per minute (100 μL/min) and three hundred microliters per minute (300 μL/min). This approach can produce inaccurate results for elements present in organometallic species that differ from those in the calibration standards. For example, with such sample flow rates and spray chamber temperatures, the different transport efficiencies of volatile organometallic silicon species can cause inaccurate results and/or long washout times. In addition, small changes in solvent composition can cause silicon background shifts.

As described herein, silicon or other metals and/or metalloids are measured at low parts per billion (ppb) levels by dramatically reducing polyatomic interferences while maintaining adequate sensitivity for the silicon and other metals and/or metalloids. A sample introduction system and an ICPMS system can accomplish a reduction in polyatomic interferences for this analysis. In embodiments of the disclosure, plasma conditions can be used that minimize the silicon background while maximizing sensitivity for silicon and/or other elements.

With reference to FIG. 1, a system 100 can include a sampler assembly, such as an autosampler 102, for automatically collecting a sample from a number of samples contained in test tubes, and so forth. The system 100 may also include a nebulizer 104 coupled with a cyclonic spray chamber 106 for supplying an ICP torch 108 with sample gas, samples from the autosampler 102, internal standard 110, carrier 112, carrier/diluent 114, and so forth. The cyclonic spray chamber 106 can be, for example, a heated cyclonic chamber, which can be heated to a temperature sufficient to volatilize one or more organic interferents (e.g., heated to at least approximately sixty degrees Celsius (60° C.) in the case of an organic solvent, such as xylene). For example, the system 100 can also include a heater 116 (e.g., a Peltier heater) coupled with the cyclonic spray chamber 106. In some embodiments, the cyclonic spray chamber 106 can be a zero waste, drainless spray chamber. In some embodiments, the system 100 can be implemented using a one and eight-tenths millimeter (1.8 mm) sapphire injector. Further, oxygen addition (e.g., twenty percent (20%) oxygen ($O_2$)/eighty percent (80%) argon (Ar)) can be used at a flow rate of at least approximately thirty six one-hundredths liters per minute (0.36 L/min) to prevent carbon buildup on the cones.

The system 100 can also include one or more rotary valves (e.g., a rotary valve 118) coupled with the autosampler 102 and the nebulizer 104. The rotary valve 118 may receive samples from the autosampler 102, the internal standard 110, the carrier 112, and/or the carrier/diluent 114 and supply them to the nebulizer 104. The rotary valve 118 may also be coupled with one or more sample loops (e.g., sample loops 120 and/or 122), e.g., for holding priming fluid and so forth. In some embodiments, the system 100 can include one or more pumps (e.g., syringe pumps 124), which can furnish samples from the autosampler 102, the internal standard 110, the carrier 112, and/or the carrier/diluent 114 at precise, low flow rates, limiting the total amount of carbon that enters the plasma and reducing carbon-based polyatomic interferences. For example, in some embodiments, a twenty microliter per minute (20 μL/min) sample flow rate can be used. In some embodiments, a ten microliter per minute (10 μL/min) internal standard flow rate can also be used. However, these flow rates are provided by way of example and are not meant to limit the present disclosure. For example, a sample flow rate can be used that is between at least approximately one microliter per minute (1 μL/min) and fifty microliters per minute (50 μL/min) (e.g., for silicon).

The system 100 also includes a collision/reaction cell 126 (e.g., a dynamic reaction cell (DRC)) where simultaneous (or at least substantially simultaneous) introduction of both ammonia ($NH_3$) and hydrogen ($H_2$) as reaction gases can be used to efficiently remove carbon-based interferences and stabilize the silicon background for excellent long-term results, regardless of solvent. In some embodiments, the reaction gases are added at flow rates of at least approximately four-tenths of a milliliter per minute (0.4 mL/min) ammonia, and two milliliters per minute (2 mL/min) hydrogen. However, these flow rates are provided by way of example and are not meant to limit the present disclosure. In other embodiments, ammonia, hydrogen, and or other reaction gases can be added at different flow rates. For example, ammonia can be added at a flow rate between at least approximately one-tenth of a milliliter per minute (0.1 mL/min) and one milliliter per minute (1 mL/min). Further, hydrogen can be added at a flow rate between at least approximately one-half of a milliliter per minute (0.5 mL/min) and five milliliters per minute (5 mL/min). For a collision/reaction cell mode, with either $NH_3$ or $H_2$ gas silicon background is significantly reduced. However, with only one of these gases, there may be enough remaining polyatomic interferences that the silicon background may still be too high for good long-term results. However, simultaneously adding both $NH_3$ and $H_2$ to the chamber reduces the background substantially, improves long-term stability, and allows accurate silicon determination in a wide variety of solvents, which can indicate a synergistic removal of carbon-based interferences using both $NH_3$ and $H_2$ that is not capable with single introduction of $NH_3$ or $H_2$.

For example, FIG. 2 shows a graph illustrating isotopic abundances, where signal intensity in counts per second versus atomic mass number to ion charge number ratio for ICPMS analysis of samples including silicon, magnesium, aluminum, and an organic solvent, and where, prior to determining the elemental composition of a sample, hydrogen alone is introduced to a collision/reaction cell (such as collision/reaction cell 126). FIG. 3 shows a graph under similar conditions as those of FIG. 2; however, both ammonia and hydrogen are introduced to the collision/reaction cell in this example. As shown, the significant interferences present in FIG. 2 at least at m/z values of 13, 25, 26, 27, and 28 are substantially or completely reduced in FIG. 3, where both ammonia and hydrogen were introduced to the collision/reaction cell. It should be noted that in the examples described with reference to FIGS. 2 and 3, magnesium is used to demonstrate that carbon-based interferences have been removed, as such interferences to magnesium may be easier to identify than organic interferences to silicon, due at least in part to the readily identifiable relative abundances of the magnesium isotopes. In this manner, magnesium can be used to "tune" the system 100 for the detection of, for instance, silicon and/or aluminum. FIG. 4 illustrates a tenfold improvement in blank reproducibility in different solvents when comparing hydrogen introduction to the collision/reaction cell with both hydrogen and ammonia introduction to the collision/reaction cell. In particular, average deviation from a xylene blank in parts per billion is shown for ICPMS analysis of samples including silicon with three different solvents (xylene, kerosene, and hexane) for a first mode, where, prior to determining the elemental composition of the sample, hydrogen is introduced to a collision/reaction cell, and for a second mode, where, prior to determining the elemental composition of the sample, both ammonia and hydrogen are introduced to the collision/reaction cell.

As described herein, the low flow rate sample introduction and heated chamber of the sample introduction system can eliminate common problems with silicon determination in organic solvents. For example, the heated chamber can furnish all (or at least substantially all) of the silicon to the plasma, e.g., regardless of the volatility of any silicon species. The low sample flow rate can maintain plasma stability despite all (or at least substantially all) of the sample and solvent reaching the plasma. In addition, shifts in silicon background due to changes in solvent composition and/or carryover from volatile species may be eliminated. In this manner, the "total consumption" sample introduction system described herein can provide accurate results for silicon regardless of species or solvent. In some embodiments, the system 100 can be operated with a wash time of at least approximately thirty-five seconds (35 s).

The sample introduction system achieves accurate silicon determination by ICPMS at low parts per billion levels. In some embodiments, the silicon detection limit may be at least approximately two and four-tenths parts per billion (2.4 ppb) (n=6, 3.4σ) in xylene at a flow rate of at least approximately twenty microliters per minute (20 μL/min). The combination of the sample introduction system and the ICPMS can provide polyatomic interference removal to achieve excellent detection limits and reproducible blanks required for low parts per billion silicon detection in undiluted organic solvents by ICPMS. For example, systems and techniques in accordance with the present disclosure can be used to automatically calibrate from a single stock standard and/or minimize offline sample preparation and dilution. The systems and techniques can also provide routine analysis of different organic solvents with the same configuration, excellent washout, low maintenance, and/or high sensitivity (e.g., without peristaltic pump tubing and/or daily maintenance).

The following discussion describes procedures that may be implemented in inductively coupled plasma apparatus providing elemental composition detection functionality. Aspects of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference may be made to the system 100 of FIG. 1.

FIG. 5 depicts a procedure 500 in an example implementation in which the elemental composition of a sample including a metal and/or a metalloid having an organic interferent is determined. As shown in FIG. 5, a sample including a metal and/or a metalloid having an organic interferent is introduced to plasma to produce a characteristic spectrum associated with an elemental composition of the sample (Block 510). For example, with reference to FIG. 1, silicon having an organic solvent, such as xylene, kerosene, and/or hexane, are introduced to the ICP torch 108. As described, the sample can be introduced at a sample flow rate of at least approximately twenty microliters per minute (20 μL/min). Then, prior to determining the elemental composition of the sample, both ammonia and hydrogen are introduced to a collision/reaction cell to remove carbon-based interferences to detection of the sample (Block 520). For instance, with reference to FIG. 1, simultaneous (or at least substantially simultaneous) introduction of both ammonia ($NH_3$) and hydrogen ($H_2$) to the collision/reaction cell 126 can be used to efficiently remove carbon-based interferences and stabilize the silicon background. As described, the ammonia can be added at a flow rate of at least approximately four-tenths of a milliliter per minute (0.4 mL/min), and the hydrogen can be added at a flow rate of at least approximately two milliliters per minute (2 mL/min).

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A method for determining an analyte by inductively coupled plasma mass spectrometry (ICPMS), the method comprising:

introducing a sample to a plasma to produce a characteristic spectrum associated with an elemental composition of the sample, the sample including at least one of a metal or a metalloid; and prior to determining the elemental composition of the sample, introducing both ammonia and hydrogen to a collision/reaction cell to remove at least one polyatomic interference to detection of the analyte.

2. The method as recited in claim 1, wherein the analyte comprises silicon.

3. The method as recited in claim 1, wherein the polyatomic interference is related to the presence of organic matter in the sample.

4. The method as recited in claim 1, wherein the sample is introduced at a sample flow rate between one microliter per minute (1 μL/min) and fifty microliters per minute (50 μL/min).

5. The method as recited in claim 1, wherein the ammonia is added at a flow rate between one-tenth of a milliliter per minute (0.1 mL/min) and one milliliter per minute (1 mL/min).

6. The method as recited in claim 1, wherein the hydrogen is added at a flow rate between one-half of a milliliter per minute (0.5 mL/min) and five milliliters per minute (5 mL/min).

7. The method as recited in claim 1, further comprising preparing the sample for analysis in a heated cyclonic spray chamber prior to introducing the sample to the plasma.

8. The method as recited in claim 7, wherein the heated cyclonic spray chamber is heated to a temperature sufficient to volatilize the polyatomic interference.

9. A system for determining an analyte by inductively coupled plasma mass spectrometry (ICPMS), the system comprising:

a sample introduction device having a heated cyclonic spray chamber and configured to introduce a sample at a sample flow between one microliter per minute (1 μL/min) and fifty microliters per minute (50 μL/min), the sample including at least one of a metal or a metalloid; and an inductively coupled plasma mass spectrometry device including a collision/reaction cell configured to receive a mixture of gases including both ammonia and hydrogen.

10. The system as recited in claim 9, wherein the analyte comprises silicon.

11. The system as recited in claim 9, wherein the system is configured to add the ammonia at a flow rate between one-tenth of a milliliter per minute (0.1 mL/min) and one milliliter per minute (1 mL/min).

12. The system as recited in claim 9, wherein the system is configured to add the hydrogen at a flow rate between one-half of a milliliter per minute (0.5 mL/min) and five milliliters per minute (5 mL/min).

13. A method for determining an analyte by inductively coupled plasma mass spectrometry (ICPMS), the method comprising:

introducing a sample to a plasma to produce a characteristic spectrum associated with an elemental composition of the sample, the sample including silicon having an organic interferent; and prior to determining the elemental composition of the sample, introducing both ammonia and hydrogen to the sample to remove at least one carbon-based interference to detection of the silicon.

14. The method as recited in claim 13, wherein the organic interferent is related to the presence of organic matter in the sample.

15. The method as recited in claim 13, wherein the ammonia is added at a flow rate between one-tenth of a milliliter per minute (0.1 mL/min) and one milliliter per minute (1 mL/min).

16. The method as recited in claim 13, wherein the hydrogen is added at a flow rate between one-half of a milliliter per minute (0.5 mL/min) and five milliliters per minute (5 mL/min).

17. The method as recited in claim 13, wherein the sample is prepared for analysis in a heated cyclonic spray chamber.

18. The method as recited in claim 17, wherein the heated cyclonic spray chamber is heated to a temperature sufficient to volatilize the organic interferent.

* * * * *